US006740808B1

(12) United States Patent
Chang

(10) Patent No.: US 6,740,808 B1
(45) Date of Patent: May 25, 2004

(54) TRANSMISSION CABLE STRUCTURE

(75) Inventor: Che-Chia Chang, Taipei Hsien (TW)

(73) Assignee: Comax Technology Co., Ltd., Taipei (TW)

( * ) Notice: Subject to any disclaimer, the term of this patent is extended or adjusted under 35 U.S.C. 154(b) by 0 days.

(21) Appl. No.: 10/412,210

(22) Filed: Apr. 14, 2003

(30) Foreign Application Priority Data

Mar. 5, 2003 (TW) ..... 92203331 U

(51) Int. Cl.[7] ..... H01B 9/02
(52) U.S. Cl. ..... 174/36; 174/113 R
(58) Field of Search ..... 174/113 R, 117 F, 174/36, 102 R, 106 R, 105 R

(56) References Cited

U.S. PATENT DOCUMENTS 4,477,693 A * 10/1984 Krabec et al. ..... 174/36
5,416,268 A * 5/1995 Ellis ..... 174/36
6,504,379 B1 * 1/2003 Jackson ..... 324/539

* cited by examiner

*Primary Examiner*—Chau N. Nguyen
(74) *Attorney, Agent, or Firm*—Troxell Law Office PLLC

(57) ABSTRACT

A transmission cable structure includes one or more propagation channels. Two insulated conductors in each of the propagation channels are joined to each other tightly as a single piece, a first cover and at least one drain wire disposed outside each of the propagation channels for location and shield, a second covering and a jacket enclosed outside the first cover and the drain wire for forming electrical shield. Therefore, the two insulated conductors joined to each other tightly can ensure the symmetry of the transmission signal, also can prevent noise effectively and the electromagnetic wave of different loops by the double shield spaces formed by the first covering and the second covering in the transmission cable, so as to improve the transmission quality of the electronic signal.

21 Claims, 4 Drawing Sheets

TRANSMISSION CABLE STRUCTURE

BACKGROUND OF THE INVENTION

1. Field of the Invention

The present invention relates to a transmission cable structure and, in particular, to a transmission cable structure used in high frequency transmission system, which can restrain loop noise and ensure the symmetry of transmission cable.

2. Description of Related Art

Due to functions of the central processing unit of a computer having been upgraded, the net bandwidth increasing and storage medium data rising tremendously, both the input and output interfaces of the periphery are getting necessary to provide larger bandwidth so that the standard for wide band transmission cables are regulated largely like bamboo shoots after spring. However, problems, such as transmission delay, impedance matching, cross talk, and ground noise control and electromagnetic wave radiation interference, resulting from high frequency signals are getting serious in the transmission cables along with the increased bandwidths of the transmission cables.

As for the transmission interfaces in a computer, Serial ATA, the serial transmission equipment, is a transmission cable providing with the highest bandwidth at the present time. Because the Serial ATA has two conductors, i.e., a transmission pair, being used as a transmission channel set for transmitting differential NRZ signal, the conductors in the same transmission channel being very much different from each other in their lengths causes signals transmitted at the same time from the input end being not possible to reach the output end simultaneously in the process of signal transmission. That is, the signals emitted from the input end are possible to be received asynchronously, and becomes the so called problem "propagation skew".

Furthermore, in a transmission system, due to the transmitting end and the receiving end have different potential; so there exists a potential drop between the transmitting end and the receiving end. The transmission system will generate a current and form a noise source due to the potential drop; therefore, for controlling the noise being generated, the transmission lines are separated from (1) signal ground loop and (2) huge current ground loop (such as ground of the chassis or frame), by separating the signal ground loop and the huge current ground loop to ensure the level of the transmission signal without effecting by coupling voltage of the other noise sources, besides, can canalize the leakage current of the chassis and prevent accident being occurred.

The U.S. Pat. No. 6,444,902, published on Apr. 20, 2001 related to the currently used transmission cable structure, mainly has two transmission channel sets includes two independent conductors, a drain wire disposed at two opposite lateral sides of the transmission channel set, an inner covering providing an effect of shield and wrapping both outer sides of the conductors and the drain wire with a conductive layer and an insulation layer from the inner side to the outer side thereof and a jacket covering the inner covering to constitute a high frequency cable.

But, the preceding transmission cable has the following problem in practice:

(1) Transmission propagation problem: due to the signal conductors of the transmission channel set without any location structure, so during being fabricated, the transmission cable is coiled up; but, the two conductors in the transmission channel easily displace because of being bent during the process of coiling such that it is not easy to control the conductors in their lengths in case of being cut it results in an signal transmission propagation and asymmetry due to the two conductors being unequal in their lengths such that the bandwidth of the transmitting frequency is limited and cannot transmit higher frequency signal.

(2) Noise control problem: due to the transmission channel set only disposed a metal shield outside the two signal conductors, only the transmission signal has a ground loop, and doesn't separate the ground loop from the huge current ground loop, thus, the huge current noise from chassis or frame will couple to the signal ground loop, so as to effect the electrical characteristic of the transmission signal and results in higher signal to noise ratio or transmission error.

SUMMARY OF THE INVENTION

Accordingly, an object of the present invention is to provide a transmission cable structure with a double shield effect and to secure the conductors in every propagation channel being kept juxtaposed and equal lengths even if the transmission cable is bent instead of the two conductors being misplaced and unequal as the prior art does so that the propagation delay at the output end can be reduced to enhance the bandwidth of the signal in the transmission cable and to improve the electrical characteristic of the transmission signal.

In order to reach the preceding object, the transmission cable structure comprises: a propagation channel set, which further comprises a pair of insulated conductors for carrying out communication of electrical appliances; a first covering, for enclosing an outer side of the propagation channel set so as to locate two insulation conductors and to form an electrical shield; at least one drain wire, being disposed outer side of the first covering and electrical connection to the first covering; a second covering, for enclosing the first covering and the drain wire, wherein, the second covering comprises at least one protection layer for forming an electrical shield; and a jacket, being an outermost layer for protecting the cable.

BRIEF DESCRIPTION OF THE DRAWINGS

The present invention can be more fully understood by reference to the following description and accompanying drawings, in which.

DETAILED DESCRIPTION OF THE PREFERRED EMBODIMENT

Figure 1:
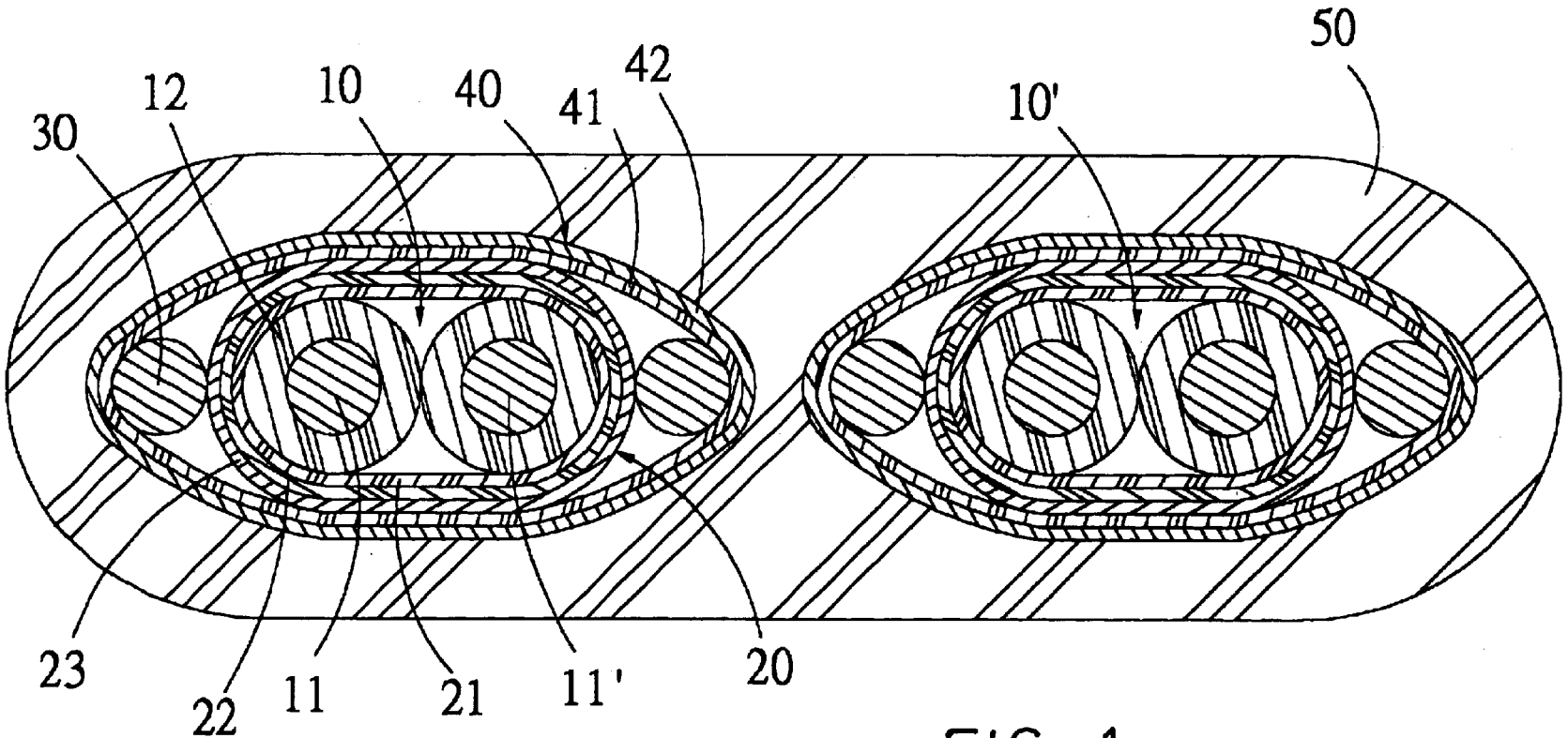
FIG. 1 is a sectional view of a transmission cable according to the present invention in an embodiment thereof.

Referring to FIG. 1, shows a sectional view of a transmission cable according to the present invention in an embodiment thereof. As shown in FIG. 1, a transmission cable structure comprises one or more propagation channel sets 10, 10' for carrying out communication of electric appliances, a respective first covering 20 for location and forming a electrical shield to each propagation channel set 10, 10', a pair of drain wires 30 disposed outer side of the first covering 20 and a second covering 40 disposed outer side of the first covering 20 and the drain wires 30 for forming a electrical shield, and a jacket 50, being an outermost layer for protecting the cable. Therefore, to secure the pair of conductors 11, 11' being juxtaposed by location of the first covering 20 and flush with each other for avoiding signals transmitted in the conductors 11, 11' becoming asymmetry due to inconsistent lengths resulting from the cable being bent, and forming a double shield space by the first covering 20 and the second covering 40 of the cable. In this way, it is capable of avoiding noise and electromagnetic wave interference from different loops and enhancing the signal transmission quality of the transmission cable.

The preceding each propagation channel set 10, 10' has the conductors 11, 11' covered respectively by a insulated rubber 12 to form a transmission pair for transmitting differential NRZ signals such that one conductor pair 11, 11' can transmit positive electrical signal and the other conductor pair 11, 11' can transmit negative electrical signal.

The first covering 20 comprises a location layer 21 for limiting the conductor pair 11, 11', a insulation layer 22 and a conductive layer 23 for avoiding electromagnetic wave interference and forming a electrical shield from the inside to the outside, wherein, the location layer is made of adhesive material, such as thermo-melting plastic material for thermo-melting two independent wires 11, 11', so as to avoid signal asymmetry due to inconsistent lengths resulting from the cable being bent. Wherein the insulation layer 22 is a polyester film, and the conductive layer 23 is a gold foil, silver foil or aluminum foil; and at least one drain wire 30 is disposed outer side of the first cover 20 for electrical connecting with the conductive layer 23 of the first cover 20 so as to form a signal ground loop and avoid electromagnetic wave interference from outside and secure the signal transmission quality of the transmission cable.

The second covering 40 comprising at least one isolated separating layer 41 is disposed inside the second covering 40 and an electrical protection layer 42, wherein, the isolated separating layer 41 is a polyester film, and the electrical protection layer 42 is a gold foil, silver foil or aluminum foil. When using, the electrical protection layer 42 can contact with the huge current ground equipment, such as chassis or frame to form a chassis ground loop for protecting the cable and to avoid generating noise interference by coupling to the signal ground loop. Besides, the outmost jacket 50 is made of PVC, PE or PP.

While the cable is made, two independent conductors 11, 11' are prepared and are arranged to juxtapose to each other with being flattened tightly by a preset tension force. Then, a strip insulator layer 22 is provided with a facial side thereof paved with conductive layer 23 such as an aluminum foil Mylar and the other facial side of the insulator layer 22 distributed with thermo-melting plastics to form a location layer 21, and forming a strip respective having a conductive layer 23 and a location layer 21 on it's opposite facial side, or using aluminum foil Mylar with self-adhesive tape. Next, the two conductors 11, 11' are coiled up or enclosed with the strip insulator tightly with the location layer 21 being arranged as the inner side of the strip insulator. The conductors 11, 11' are heated up immediately right after being coiled up or enclosed with the insulated rubber 12 so that the thermo-melting plastic material melts to join with the insulation plastic covering as a locating layer 21 so as to form the first covering 20.

Further, the drain wire 30 is disposed at lateral side of the conductive layer 23 of the first covering 20, and then, enclosing a polyester film outside the first covering 20 and the drain wire 30 to form an isolated separating layer 41, and using circular metal braid method to enclose the isolated separating layer 41 to form the electrical protection layer 42. Finally, the jacket 50 is formed by way of PVC, PE or PP being injection molded to cover the entire propagation channels 10, 10'. Hence, a transmission cable structure with the conductor pair 11, 11' of the propagation channels 10, 10' being in a state of juxtaposing and being equal in their lengths and having double shield protection can be fixed up completely.

By preceding structure, the present invention forms a double shield spaces in the cable by the first covering 20 and the second covering 40 to separate the signal ground loop and the huge current ground loop so that the noise and the electromagnetic wave of the different loops can be avoided effectively and the transmission quality of the electronic signal can be improved. Further, the present invention by way of the location of the first covering 20 makes the conductor pair 11, 11' being jointed together tightly as a whole, and keeps the conductor pair 11, 11' being juxtaposed and equaled in their lengths. Thus, while transmission, such transmission cable structure can reduce the signal asymmetry due to the relative loop difference such that the bandwidth of the transmission cable can be increased.

Figure 2:
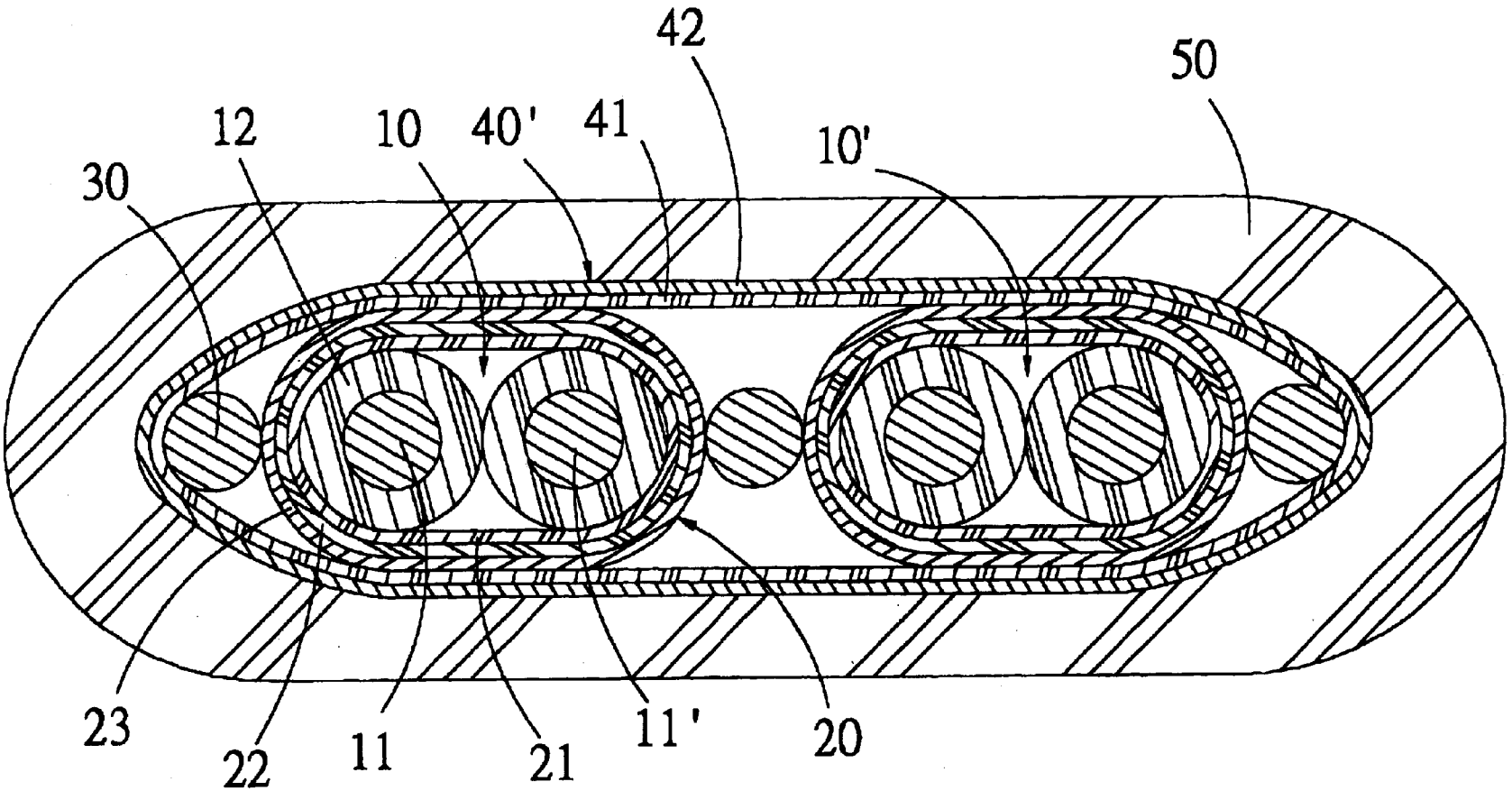
FIG. 2 is a sectional view of another embodiment of the present invention.

Referring to FIG. 2, shows a sectional view of another embodiment of the present invention. As shown in FIG. 2, the transmission cable structure of this embodiment is approximately to the preceding structure. But, while the cable is made, which uses a second covering 40 to enclose the first covering 20 of the two conductors 11, 11' and the drain wires 30, and enables the two propagation channel (conductors) 10, 10' to share the ground loop formed by the second covering 40. Besides, in this way, it can construct a conductor pair 11, 11' of a propagation channel 10, 10' being juxtaposed and equaled in their lengths, and also can construct a high frequency transmission cable having double shields protection.

Figure 3:
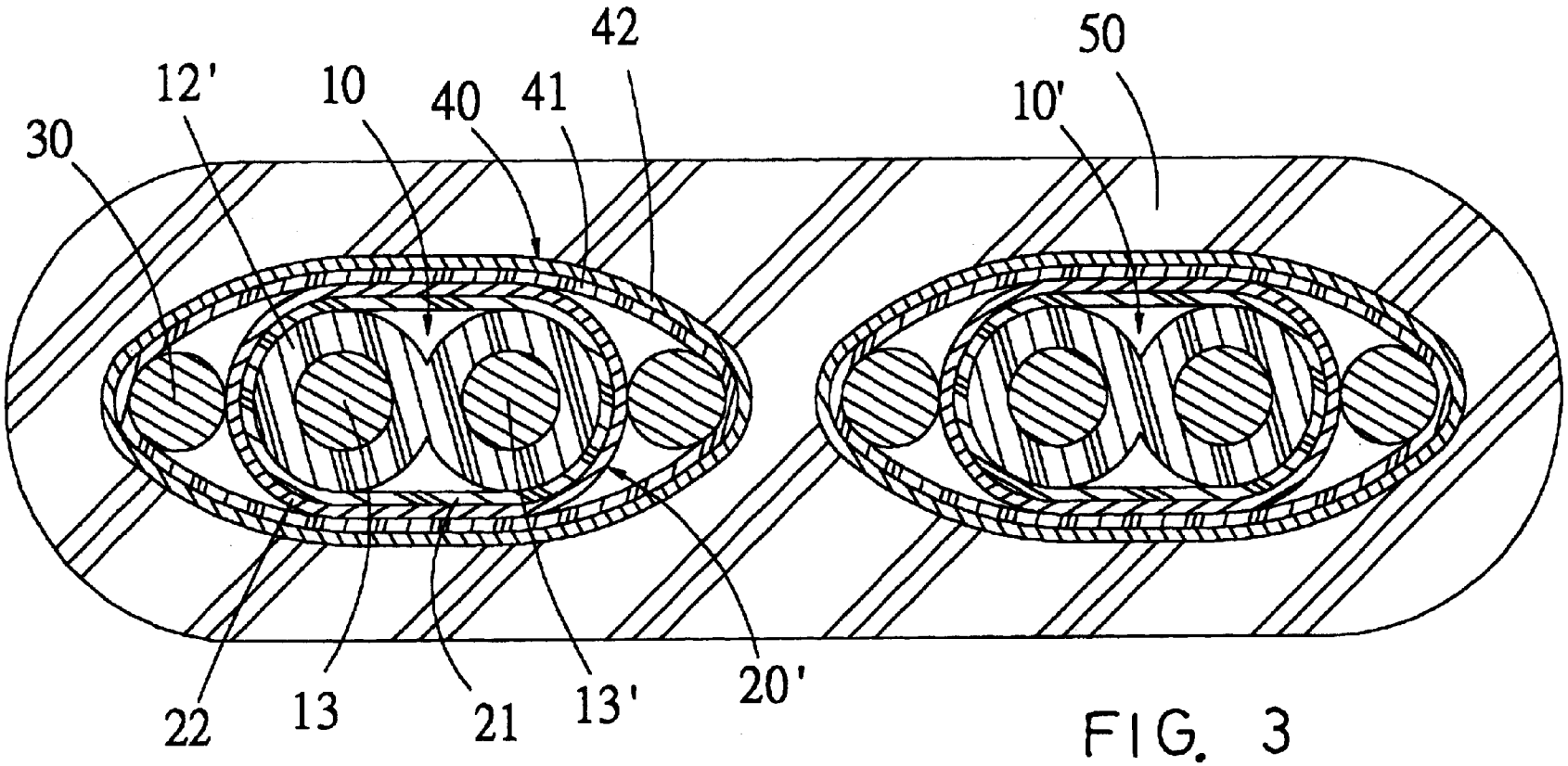
FIG. 3 is a sectional view of a further embodiment of the present invention.
Figure 4:
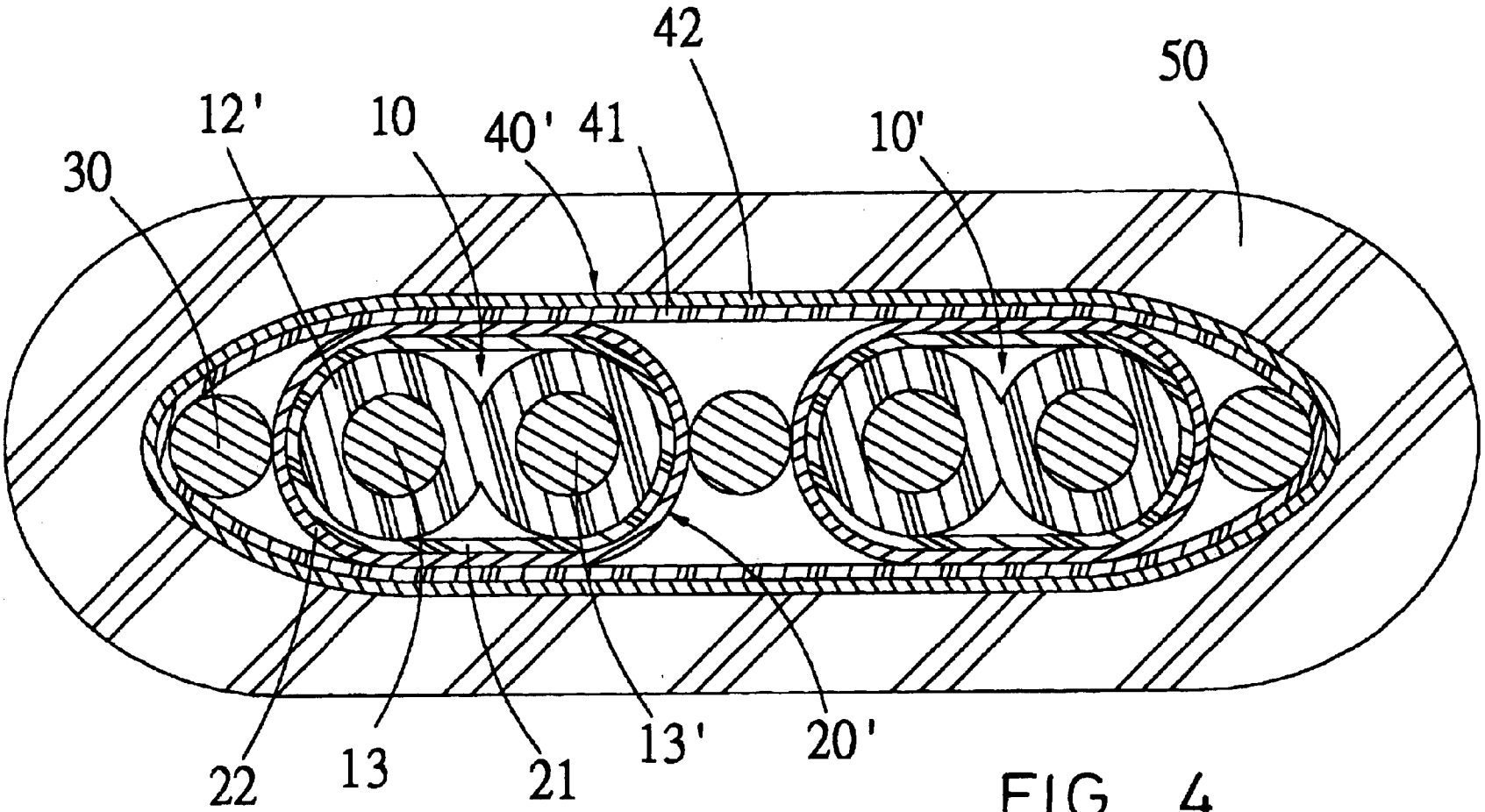
FIG. 4 is a sectional view of a still further embodiment of the present invention.

Besides, referring to FIGS. 3 and 4, respectively shows a sectional view of a further embodiment and a still further embodiment of the present invention. As shown in FIGS. 3 and 4, while the cable is made, the conductor pair 13, 13' are fabricated as a set by way of wiring arrangement and being juxtaposed to each other to form a propagation channel 11, 11' for carrying out communication job of electrical appliances. Due to the insulated rubber 12 of the cable is manufactured as a whole for securing the propagation channel 11, 11' being juxtaposed and equaled in their lengths, and making the lengths of the propagation channel 11, 11' that carried out communication job of electrical appliances not easy to unequal because of bending, so as to ensure the symmetry of the transmission signal. The first covering 20' further comprises a insulation layer 22 and a conductive layer 23 from the inside to the outside, wherein, the insulation layer 22 is a polyester film, and the conductive layer 23 is a gold foil, silver foil or aluminum foil, or the first covering 20' is only a gold foil, silver foil or aluminum foil (not shown) so as to form a electrical shield.

Furthermore, referring to FIG. 3, a further embodiment of the present invention is illustrated. While the cable is made, a second covering 40 enclosing all the conductor pair 13, 13' of the first covering 20' and the drain wires 30 for forming an electrical shield, so as to prevent noise and electromagnetic wave the of different loops effectively by the double shield spaces formed by the first covering 20' and the second covering 40 in the transmission cable, and to improve the transmission quality of the electronic signal.

Furthermore, referring to FIG. 4, a still further embodiment of the present invention is illustrated. While the cable is made, a second covering 40' enclosing all the conductor pair 13, 13' of the first covering 20' and the drain wires 30 for forming an electrical shield, and making the propagation channels 10,10' with a plurality of first covering 20' to share the ground loop formed by the second covering 40.

Therefore, by using the propagation channels 10,10' (as shown in FIGS. 3 and 4) fabricated by juxtaposing wire can secure the conductor pair 13, 13' being juxtaposed and equaled in their lengths, and avoiding the signal asymmetry generated by relative different loops when bending. Further, by using the first covering 20' and the second covering 40 to form the double shields in the cable, can reduce the signal asymmetry due to the relative loop difference such that the bandwidth of the transmission cable can be increased.

While the invention has been described with reference to the a preferred embodiment thereof, it is to be understood that modifications or variations may be easily made without departing from the spirit of this invention, which is defined by the appended claims.

What is claimed is:

1. A transmission cable structure comprising:

a) at least one propagation channel set having:

i) two space apart insulated conductors;

ii) a first covering enclosing the two insulated conductors and having a conductive layer and an insulation layer located on an inner periphery of the conductive layer;

iii) at least one drain wire located on the outer periphery of the first covering and electrically connected to the conductive layer of the first coating; and iv) a second covering having an electrical protection layer on an outer periphery and an isolated separating layer on an inner periphery thereof, the isolated separating layer of the second covering positioned adjacent to and enclosing the first covering and the at least one drain wire; and b) a jacket covering the electrical protection layer of the second covering.

2. The transmission cable structure according to claim 1, wherein each of the two spaced apart insulated conductors has an insulative cover.

3. The transmission cable structure according to claim 2, further comprising a location layer made of an adhesive material located between the insulation layer and the two insulated conductors for positioning the two insulated conductors.

4. The transmission cable structure according to claim 1, wherein the two spaced apart insulated conductors have a common insulative cover.

5. The transmission cable structure according to claim 1, wherein the electrical protection layer is a metal braid.

6. The transmission cable structure according to claim 1, wherein the insulation layer is a polyester film.

7. The transmission cable structure according to claim 1, wherein the conductive layer is selected from a group consisting of a gold foil, aluminum foil, and silver foil.

8. The transmission cable structure according to claim 1, wherein the isolated separating layer is a polyester film.

9. The transmission cable structure according to claim 1, wherein the electrical protection layer is selected from a group consisting of a gold foil, aluminum foil, and silver foil.

10. The transmission cable structure according to claim 1, wherein the jacket is made from a material selected from the group consisting of PVC, PE, and PP.

11. A transmission cable structure comprising:

a) at least two propagation channel sets, each of the at least two propagation channel sets having:

i) two spaced apart insulated conductors; and ii) a first covering enclosing the two insulated conductors and having a conductive layer and an insulation layer located on an inner periphery of the conductive layer;

b) at least one drain wire located on a outer periphery of one of the at least two propagation channel sets and electrically connected to the conductive layer of the first covering;

c) a second covering having an electrical protection layer on an outer periphery and an isolated separating layer on an inner periphery thereof, the isolated separating layer of the second covering positioned adjacent to and enclosing the first covering and the at least one drain wire; and d) a jacket covering the electrical protection layer of the second covering.

12. The transmission cable structure according to claim 11, wherein the at least one drain wire includes three drain wires.

13. The transmission cable structure according to claim 11, wherein each of the two spaced apart insulated conductors has an insulative cover.

14. The transmission cable structure according to claim 13, further comprising a location layer made of an adhesive material located between the insulation layer and the two insulated conductors for positioning the two insulated conductors.

15. The transmission cable structure according to claim 11, wherein the two spaced apart insulated conductors have a common insulative cover.

16. The transmission cable structure according to claim 11, wherein the electrical protection layer is a metal braid.

17. The transmission cable structure according to claim 11, wherein the insulation layer is a polyester film.

18. The transmission cable structure according to claim 11, wherein the conductive layer is selected from a group consisting of a gold foil, aluminum foil, and silver foil.

19. The transmission cable structure according to claim 11, wherein the isolated separating layer is a polyester film.

20. The transmission cable structure according to claim 11, wherein the electrical protection layer is selected from a group consisting of a gold foil, aluminum foil, and silver foil.

21. The transmission cable structure according to claim 11, wherein the jacket is made from a material selected from the group consisting of PVC, PE, and PP.

* * * * *